United States Patent [19]

Ray, III

[11] Patent Number: 4,753,058

[45] Date of Patent: Jun. 28, 1988

[54] ELEVATED FLOOR PANEL AND METHOD OF MANUFACTURING SAME

[75] Inventor: George F. Ray, III, Rockville, Md.

[73] Assignee: Donn Incorporated, Westlake, Ohio

[21] Appl. No.: 905,951

[22] Filed: Sep. 11, 1986

[51] Int. Cl.[4] ..... E04C 2/32

[52] U.S. Cl. ..... 52/792; 52/806; 52/809

[58] Field of Search ..... 52/792, 806, 808, 809, 52/814

[56] References Cited

U.S. PATENT DOCUMENTS

| | | | |
|---|---|---|---|
| 2,391,997 | 1/1946 | Noble | 52/792 |
| 3,011,602 | 12/1961 | Ensrud et al. | 52/792 |
| 3,025,935 | 3/1962 | Ensrud et al. | 52/808 |
| 3,196,763 | 7/1965 | Rushton | 52/792 |
| 3,258,892 | 7/1966 | Rushton | 52/792 |
| 3,279,973 | 10/1966 | Arne | 52/792 |
| 3,525,663 | 8/1970 | Hale | 52/792 |
| 3,876,492 | 4/1975 | Schott | 52/792 |
| 4,411,121 | 10/1983 | Blacklin et al. | 52/792 |

FOREIGN PATENT DOCUMENTS

| | | | |
|---|---|---|---|
| 244130 | 4/1960 | Australia | 52/792 |
| 709279 | 5/1954 | United Kingdom | 52/792 |
| 2051909 | 1/1981 | United Kingdom | 52/792 |

*Primary Examiner*—Carl D. Friedman

*Assistant Examiner*—Michael Safavi

*Attorney, Agent, or Firm*—Pearne, Gordon, McCoy & Granger

[57] ABSTRACT

An elevated floor panel is disclosed in which a lower sheet metal element is formed with a plurality of projections extending from the lower plane of the panel to the upper planar surface. The projections are formed in sequential die drawing operations. In the first die drawing operation, square truncated pyramids of intermediate height are drawn so that the upper surfaces of the intermediate projections provide substantially unworked material. In the second drawing operation, four symmetrically arranged, semispherical projections are drawn from the unworked material at the tops of the preliminary projections. The tops of the semispherical projections are flattened and are welded to an upper sheet member to provide efficient stress transfer between the two sheet metal portions of the panel. By sequentially performing two drawing operations on material which is substantially unworked prior to each drawing operation, it is possible to reliably produce projections of greater depth. The compound projections resulting from the two drawing operations provide a compound beam system which efficiently transfers stress to provide a rigid, strong panel. The cavity between the two members is, in some cases, filled with a lightweight concrete.

8 Claims, 2 Drawing Sheets

ELEVATED FLOOR PANEL AND METHOD OF MANUFACTURING SAME

BACKGROUND OF THE INVENTION

This invention relates generally to elevated floor panels adapted to be supported at their corners, and more particularly to a novel and improved, elevated floor panel having a lower sheet metal member formed with a double draw.

PRIOR ART

Various elevated floor panels are formed by combining a substantially planar sheet metal cover member with a lower or base sheet metal member which has been subjected to die drawing operations to provide an array of projections which extend from the lower surface of the panel to the upper cover member. Such panels provide a beamlike structure in which the cover and base are interconnected at relatively closely spaced intervals to provide a strong, substantially rigid structure. Examples of such floor panels are illustrated in United States Pat. Nos. 3,011,602; 3,876,492; and 4,411,121.

It is also known to provide panels with a face or lower sheet metal member which is die drawn to provide 25 projections each having a shape which is substantially a square, truncated pyramid. Such pyramids are welded along their upper surfaces to the upper or cover sheet. Such panels are often filled with cementitious material or the like, and in other instances, such panels are hollow. Such prior art panels, which have been marketed by the assignee of this invention, are die-formed so that the height of the truncated pyramids is greater along the periphery but is less along the central portions of the panels. This arrangement, in which the truncated pyramid projections have less depth along the central portions of the panel, is provided to eliminate problems encountered when attempting to make draws of greater height. Because the depth of the truncated pyramids is reduced along the central portion of the panel, some reduction of strength and rigidity results.

SUMMARY OF THE INVENTION

The present invention provides a novel and improved, elevated floor panel and a novel and improved method for producing such panel.

In accordance with one aspect of this invention, a lower or base sheet metal member is die-drawn in two operations to provide an array of projections extending the full distance between the plane of the lower panel face and the plane of the upper panel face. During the first drawing operation, projections of intermediate height are formed in such a manner that a relatively large, central portion of the metal forming each of the intermediate projections is substantially unworked. Thereafter, in a second drawing operation, such unworked central portions are drawn to form projections extending beyond the intermediate height to provide the required full projection height.

Because the two separate drawing operations are each performed on metal, which prior to the drawing operations is substantially unworked, and because each draw is to a height less than the required total height, satisfactory drawing operations can be reliably performed and projections of greater height are possible.

Further, because the total thickness of the resultant panel can be uniformly maintained, a stronger, more rigid panel can be produced from a given thickness of material.

In the illustrated embodiment, a base sheet of metal is die-drawn to form an array of projections of intermediate height having a shape of a square, truncated pyramid. The upper surface of each pyramid provides a substantially square central portion which is substantially unworked. Such unworked metal is subsequently drawn to form four symmetrically arranged, generally semispherical projections having a flattened upper surface.

A cover member or sheet is then welded to the flattened upper surfaces of the semispherical projections. In some instances, the panels are filled with lightweight concrete material or the like. However, such panels can also be used without such filling material.

In the illustrated embodiment, the first drawing operation produces 25 truncated pyramids arranged in rows of five having a height of about $\frac{3}{4}$ inch. The second drawing operation produces 100 semispherical projections about $\frac{1}{2}$ inch high. Consequently, the total height of the projections is about $1\frac{1}{4}$ inches. Because the individual drawing operations are of lesser depth, they can be produced reliably with less difficulty. Further, each of the projections is connected to the cover sheet by a spot weld so that the cover sheet and the base sheet are interconnected at relatively closely spaced intervals to provide good stress transfer between the two metal parts and good support for the cover sheet.

Further, the combined structural shapes of the projections efficiently function to provide effective stress transfer. The upper spherical projections cooperate to form an upper beam system which is rigid and provides substantial strength. Such upper beam system efficiently trasnfers stresses from the cover to the upper portions of the truncated pyramids. Such stresses are then supported by the lower beam system provided by the truncated pyramid array. These two beam systems combine to provide a very rigid and strong panel which maximizes the efficient use of the material forming the panel.

In instances in which the panel is filled with a cementitious material or the like, such material extends between the spherical projections and provides a support intermediate the weld which reduces any tendency for dimpling to occur when concentrated loads are applied to the cover sheet. Further, such structure provides improved sound deadening characteristics.

With the present invention, it is possible to produce an improved, elevated floor panel which is stronger and more rigid for a given amount of material required for the production of the panels and to achieve the die drawing operations in a reliable manner without difficulty.

These and other aspects of this invention are illustrated in the accompanying drawings, and are more fully described in the following specification.

DETAILED DESCRIPTION OF THE DRAWINGS

Figure 1:
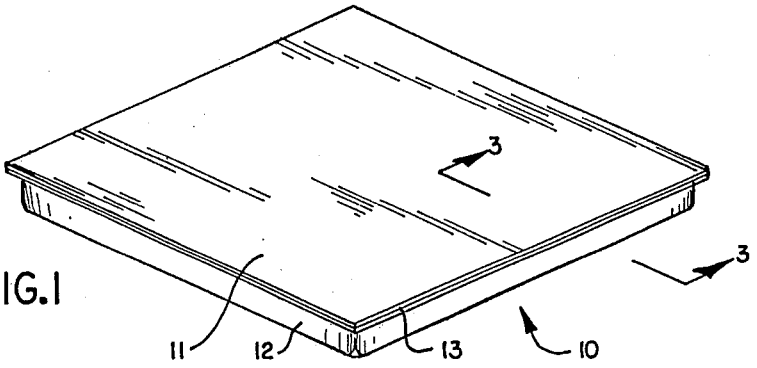
FIG. 1 is a perspective view of a panel incorporating this invention.
Figure 2:
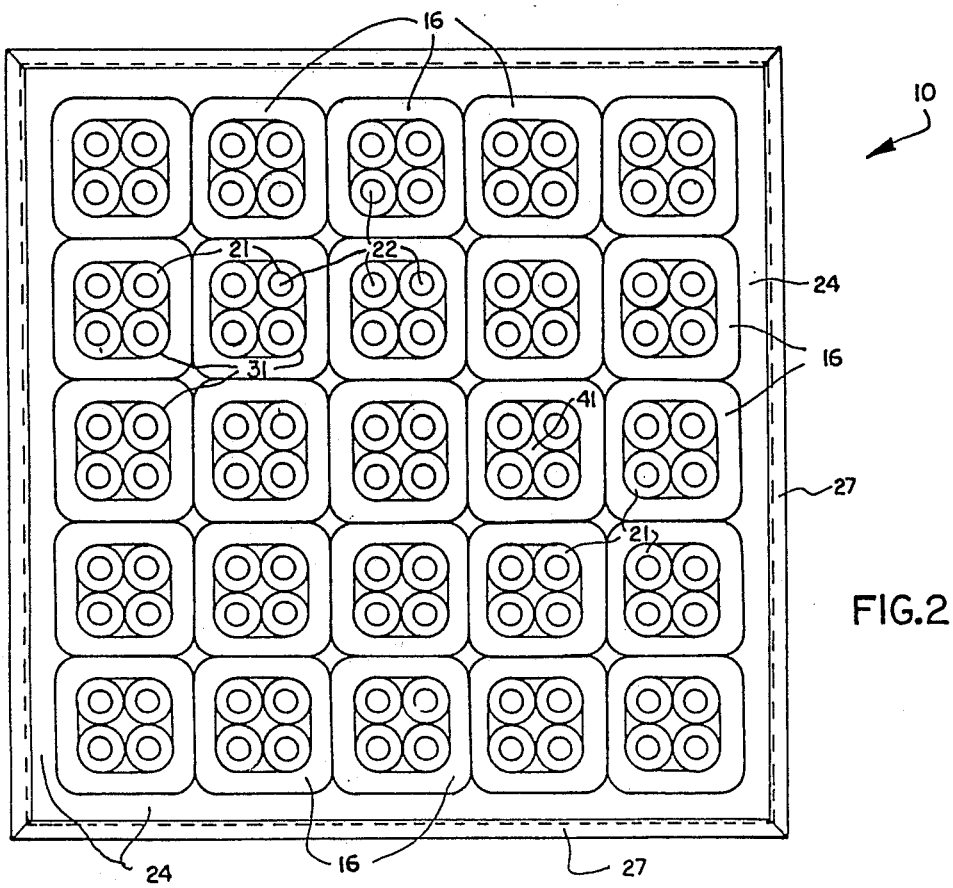
FIG. 2 is a plan view of the base member of a preferred embodiment of this invention, illustrating the arrangement of the projections formed therein.

FIG. 1 illustrates a typical elevated floor panel 10 incorporating the present invention. Such panel is adapted to be supported at its corners on pedestals (not illustrated) and assembled in an array to provide a floor system spaced from the base floor system of a building. The illustrated panel 10 includes an upper cover sheet 11 and a base sheet 12 which are welded along the periphery of the panel at 13 to provide a unitary structure. In some embodiments of this invention, the panel is filled with a lightweight cementitious material 14 illustrated in FIG. 3. However, it is also within the scope of this invention to form a panel which is hollow and consists only of the upper and lower sheets 11 and 12.

Referring to FIGS. 2 through 5, the base sheet 12 is formed with a plurality of compound projections 16. In the illustrated embodiment, the panel 10 is square and provided with 25 compound projections 16 arranged in an array of perpendicularly extending rows, with each row containing 5 compound projections. It should be understood that the number of rows and the number of projections in each row is not critical to the present invention.

Each of the compound projections 16 includes a lower truncated pyramid portion 17 which extend from a plane 18 extending along the lower side of the panel to an intermediate plane 19. Extending from the intermediate plane 19, each compound projection provides four symmetrically arranged, generally semispherical projection portions 21. Each of these semispherical projection portions 21 provides a flattened upper extremity 22 which is coplanar with the flattened surfaces of the other semispherical projection portions. The cover sheet 11, which is a planar member, is welded to each of the flattened extremities 22 by welds 23 so as to produce a unitary structure.

The rows of projections are spaced inwardly from the side edges of the panel to provide a peripheral wall 24 joining the outermost compound projections 16 to an upstanding side wall 26. Such peripheral wall extends along the plane 18 and is spaced from the upper cover sheet 11 by the full depth of the panel. The upper extremity of the side wall 26 is bent at right angles to provide a peripheral flange 27 engaging the lower side of the cover sheet 11 and welded thereto by the weld 13.

Figure 3:
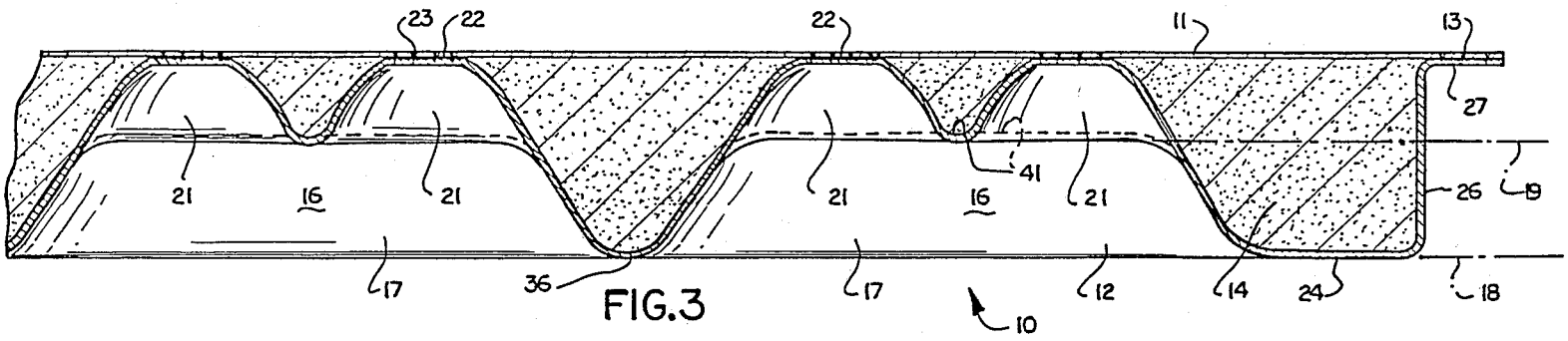
FIG. 3 is an enlarged, fragmentary section of a concrete-filled panel taken along line 3—3 of FIG. 1, and illustrating the shape of the projections.

In the embodiment of FIG. 3, the cavity defined by the cover sheet 11 and the base sheet 12 is filled with lightweight cementitious material 14. Such material provides the panel with additional rigidity and supports the cover sheet, resisting the tendency for the cover sheet to dent when relatively conncentrated loads are applied thereto. Further, the lightweight cementitious material provides a substantially amount of sound deadening along substantially the entire surface of the panel, and thereby reduces the tendency for the panel to emit noise characteristic of metal panels if objects are dropped on the panel. Since the cementitious material 14 provides support for the cover sheet 11, it can be formed of relatively thin material without becoming susceptible to denting and the like. Further, even in the zones where cementitious material does not exist to support the cover sheet, sufficient strength is provided because a double layer of metal is provided by the flattened extremity 22 in combination with the cover sheet 11.

Figure 4:
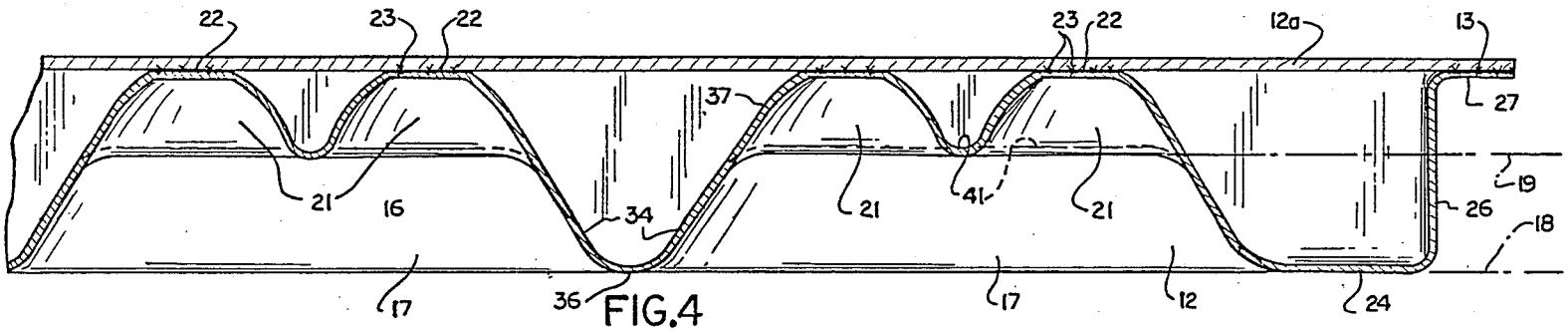
FIG. 4 is an enlarged, fragmentary section, similar to FIG. 3 illustrating a panel that does not include a cementitious filler.
Figure 5:
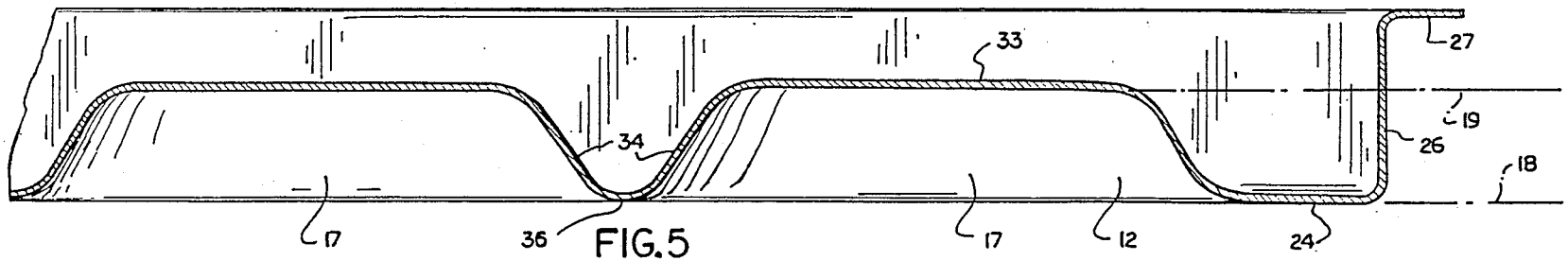
FIG. 5 is a fragmentary section illustrating the base sheet member at the completion of the first drawing operation before the spherical projections are produced by a second drawing operation.

FIG. 4 illustrates a second embodiment in which the panel is unfilled and remains hollow. In such embodiment, the base sheet is formed in the identical manner as the base sheet of the first embodiment. However, in this embodiment, the cover sheet **12*a* is of thicker gauge so as to provide the necessary resistance to denting under concentrated loads. In both embodiments, however, the cover sheet and the base sheet are interconnected at relatively closely spaced intervals so that good support is provided for the cover sheet along its entire surface and a cooperative beam system is established to provide a high degree of rigidity. Because the welds 23** are located at closely spaced intervals along the entire panel, at 100 locations in the illustrated embodiment, sufficient interconnection is provided to produce good stress transfer between the cover sheet and the base sheet for high strength and rigidity.

Further, because the compound projections are formed with curved surfaces, the tendency for the metal to buckle or bend in localized areas is greatly diminished. It should be noted that in FIG. 2, which illustrates the arrangement of the array of projections, even the corners 31 of the truncated pyramid portions are rounded to minimize sharp corners which could produce problems in the forming of the projections, and which could create localized stress conditions which could result in buckling and the like.

The compound projections 16 in the base sheet are formed in sequential drawing operations. At the completion of the first drawing operation, the base sheet is provided with 25 projections arranged in rows of 5, in which each projection is in the shape of a square, truncated pyramid 32. The upper surface 33 of such pyramids 32 is flat and substantially unworked during the first drawing operation. During the forming operation in which the truncated pyramids 32 are produced, the metal of the side wall 34 is stretched beyond its elastic limit and is thinned to some extent. Further, such metal tends to be work-hardened. Preferably, the angle of the side walls 34 is selected so that such side walls are sloped to a substantial extent. This ensures that a substantial amount of metal is available for the drawing operation in which the side walls 34 are formed. The lower ends of the side walls 34 are formed with ample radius so that a smooth transition is provided between the material at the base 36 of the side walls 26 and also to retain a substantial amount of metal between the projections at the lower plane 18. The material at the bases 36 of the sidewalls of the lower projections cooperate to provide an array of beams extending between the sides of the panel substantially along the lower plane 18. In the illustrated embodiment, the total depth of the panel is about $1\frac{1}{4}$ inches, and the height of the truncated pyramids is about $\frac{3}{4}$ inch. Therefore, the upper surface 33 of each pyramid extends along the intermediate plane 19 spaced from the plane 18 by about $\frac{3}{4}$ inch. Those skilled in the art will recognize that the drawing of the metal to produce the truncated pyramids can be performed reliably without great difficulty because such draw is relatively shallow.

During a second drawing operation, the material of the upper surface 33 of each truncated pyramid which is substantially unworked during the first drawing operation is subsequently drawn in dies to form the substantially semispherical projecting portions 21 in this illustrated embodiment. Here again, the depth of the second drawing operation used to form the generally spherical projections 21 is relatively small. In this illustrated embodiment, the spherical projections have a total height of only ½ inch. However, the total height of the compound projections 16 is 1¼ inches. Therefore, relatively high projections are produced without subjecting the material of the base sheet to deep drawing operations. Because the metal which is drawn during the second operation is substantially unworked during the first drawing operation, the second drawing operation is performed on substantially virgin material which has not been previously work-hardened.

Further, with the two drawing operations, better control of the stretching of the metal is provided because a large area of metal is not being drawn during a given drawing operation.

Because each of the compound projections extends the full distance between the lower plane 18 and the plane of the upper sheet 11, the panel has a good moment of inertia and the ability to support substantial loads on the upper surface of the panel with a minimum amount of deflection. Because the outermost rows of the compound projections are spaced from the side walls 26, a substantial amount of metal is provided at the upper and lower surfaces of the panel to support edge loading of the panel where the greatest stresses occur for a given load on the panel. In the illustrated embodiment, the semispherical projections are shaped so that the lower extremities of the adjacent portions of their side walls 37 are in substantial alignment with the side walls 34 of the truncated pyramid portion of the compound projection. Therefore, the curved portions 31 at the corners of the truncated pyramids blend into the associated portions of the side walls 37 of the spherical projections. Because the compound projections provide compound curves, as mentioned above, there is very little tendency for the material forming the compound projections to buckle under loading conditions.

Further, the semispherical projections 21 cooperate with the cover sheet 12 or **12*a* to provide an upper beam system shaped to provide for the effective support of the cover 12 or 12*a* and to transfer stress to the upper extremity of the truncated pyramids. Such upper beam system includes compound curved surfaces provided by the semispheical projections themselves and the portion 41 of the surface 33 which remains in the plane 19 after the second drawing operation. Such portion 41 is spaced from and is substantially parallel to the cover 12 and cooperates therewith to provide an upper beam system at the upper extremity of each compound projection 16 which is strong and rigid. Therefore, the upper beam system efficiently transfers stress to the upper extremities of the truncated pyramids 17**.

The truncated pyramids cooperate to provide a lower beam system which combines with the upper beam system to provide a combined beam system of substantial depth for supporting the loads applied to the covers 12 or **12*a***. Because these beam systems cooperate to provide a combined beam system of full panel depth over the entire panel, higher loads can be satisfactorily supported for a given amount of material forming the panel.

With the present invention, it is possible to reliably produce an improved panel having a high degree of rigidity with metal of minimum thickness so that the material cost of producing the panel is minimized.

Although the preferred embodiments of this invention have been shown and described, it should be understood that various modifications and rearrangements of the parts may be resorted to without departing from the scope of the invention as disclosed and claimed herein.

What is claimed is:

1. A rectangular sheet metal elevated floor panel having upper and lower spaced apart surfaces, comprising a unitary base sheet and a unitary cover sheet, said base sheet providing an array of lower projections of a predetermined size, each of said lower projections having inclined side walls extending with progressively decreasing cross section to an upper extremity completely enclosed by said inclined side walls and spaced from and unconnected with the upper extremities of the other of said lower projections, at least a portion of the upper extremity within said inclined side walls being defined by intermediate portions of said base sheet extending substantially parallel to said cover sheet, said base sheet also providing between said lower projections an array of substantially straight beams with each of said beams extending entirely across said panel along said lower surface, said base sheet also providing an array of separate upper projections extending from said intermediate portions of said lower projections having a size less than said predetermined size and extending to upper extremities, said upper extremities of said upper projections being connected to said cover sheet, said upper projections in combination with said cover sheet forming a beam system operable to efficiently transfer stress from said cover sheet to said lower projections and distribute said stress over said unitary base sheet, said upper and lower projections cooperating with said cover sheet to provide a composite beam system of substantial depth operable to efficiently support loads applied to said cover sheet.

2. A floor panel as set forth in claim 1, wherein said lower projections are truncated and provide said inclined walls of substantially uniform thickness, and a plurality of upper projections on each of said lower projections extending from said upper extremity thereof, said upper projections also being provided with inclined walls of substantially uniform thickness.

3. A floor panel as set forth in claim 2, wherein said lower projections are substantially square truncated pyramids.

4. A floor panel as set forth in claim 3, wherein said upper projections are generally semispherical in shape and are provided with flattened extremities engaging said cover sheet and welded thereto.

5. A floor panel as set forth in claim 4, wherein said base sheet and cover sheet cooperate to define a cavity therebetween, and said cavity is filled at least in part with a sound deadening material.

6. A floor panel as set forth in claim 5, wherein said cavity is filled with a cementitious material.

7. A floor panel as set forth in claim 1, wherein said array of upper projections includes a plurality of upper projections extending from each of said upper extremities.

8. A rectangular sheet metal floor panel having upper and lower surfaces extending along upper and lower spaced-apart planes and being adapted to be supported at its corners, comprising a unitary base sheet and a unitary cover sheet, said base sheet providing an array of truncated pyramids extending substantially from said lower plane to an intermediate plane and a plurality of generally semispherical projections extending from each truncated pyramid at said intermediate plane to an upper extremity in said upper plane, said cover sheet being welded to the upper extremities of said projections, said base sheet providing material between said truncated pyramids forming an array of substantially straight beams extending across said panel substantially along said lower plane, said base and cover sheets cooperating to provide a beam system operable to support loads applied to the surface of said cover sheet.

* * * * *